United States Patent [19]

Anderson

[11] 4,158,583

[45] Jun. 19, 1979

[54] HIGH PERFORMANCE AMMONIUM NITRATE PROPELLANT

[76] Inventors: Robert A. Frosch, Administrator of the National Aeronautics and Space Administration, with respect to an invention of Floyd A. Anderson, Pasadena, Calif.

[21] Appl. No.: 861,390

[22] Filed: Dec. 16, 1977

[51] Int. Cl.[2] ..... C06B 45/10

[52] U.S. Cl. ..... 149/19.4; 149/19.9; 149/20

[58] Field of Search ..... 149/19.4, 19.9, 19.91, 149/20

[56] References Cited

U.S. PATENT DOCUMENTS

| | | | |
|---|---|---|---|
| 3,018,203 | 1/1962 | Guth | 149/19.9 |
| 3,695,952 | 10/1972 | Allen | 149/19.9 |
| 3,790,416 | 2/1974 | Dehm | 149/19.9 |
| 3,924,405 | 12/1975 | Cohen et al. | 149/19.9 |
| 3,954,528 | 5/1976 | Chang et al. | 149/19.9 |
| 3,957,549 | 5/1976 | Baldwin | 149/19.91 |
| 4,019,933 | 4/1977 | Cucksee et al. | 149/19.9 |
| 4,084,992 | 4/1978 | Hightower et al. | 149/19.9 |

*Primary Examiner*—Edward A. Miller
*Attorney, Agent, or Firm*—Wilfred Grifka; John R. Manning; Monte F. Mott

[57] ABSTRACT

A high performance propellant having greatly reduced hydrogen chloride emission is disclosed comprising a minor amount of hydrocarbon binder (10–15%) and at least 85% solids including ammonium nitrate as the primary oxidizer (about 40% to 70%), a significant amount (5–25%) powdered metal fuel, such as aluminum, a small amount (5–25%) of ammonium perchlorate as a supplementary oxidizer and optionally a small amount (0–20%) of a nitramine such as HMX.

9 Claims, No Drawings

HIGH PERFORMANCE AMMONIUM NITRATE PROPELLANT

ORIGIN OF THE INVENTION

The invention described herein was made in the performance of work under a NASA contract and is subject to the provisions of Section 305 of the National Aeronautics and Space Act of 1958, Public Law 83-568 (72 Stat. 435; 42 USC 2457).

BACKGROUND OF THE INVENTION

1. Field of the Invention

The present invention relates to a high performance solid rocket propellant and, more particularly, to an ammonium nitrate propellant having greatly reduced hydrogen chloride emissions.

2. Description of the Prior Art

Recently there was considerable concern that the cumulative quantity of HCl gas which would be emitted into the stratosphere from the solid propellant would be sufficient to possibly create a potentially serious hazard to life on earth, particularly to humans. The concern arose from the fact that the conventional ammonium perchlorate baseline propellant normally utilized in rocket motors and boosters produces an exhaust during burn which contains between 21 and 22 weight percent HCl gas. The concern was that this quantity of HCl released into the stratosphere may be sufficient to disrupt the natural ultra violet radiation shield in the stratosphere. The theory being that the chlorine from the exhaust could catalytically deplete the ozone in the stratosphere to the point where a health hazard could result for people here on earth from the increase in the ultra violet radiation reaching the earths surface. For the Space Shuttle and other future aerospace flights, a propellant performance specification goal has been suggested which would keep HCl in the exhaust at or below about 3% level. An environmentally acceptable high performance propellant with zero or minimal HCl emissions has long been desired.

Propellants containing ammonium nitrate (AN) as oxidizer do not produce the objectionable hydrogen chloride emissions. However, in most previous AN propellants the highest solids loading has been 78–80% in order to have a workable master-batch for casting a motor and the highest reported solids loading has been at about 82%. Furthermore, AN propellants usually have burning rates of about 0.1 in/sec at 1000 psia which is a factor of three times below the specification for the Space Shuttle propulsion system.

SUMMARY OF THE INVENTION

Propellants having the combustion efficiency and high burning rates normally only achieved with perchlorates, have now been formulated with ammonium nitrate as the primary oxidizer, and with powdered metal fuel, all of which permits the use of lesser amounts of perchlorate oxidizer. These novel formulations greatly reduce the total hydrogen chloride emissions to the atmosphere, and hence are particularly suitable for the Space Shuttle propulsion systems.

The novel propellant formulations of this invention provide a maximum of 3 weight percent HCl at burning rates of 0.30 to 0.35 in/s at 1000 psia, which burning rates had never previously been attained with ammonium nitrate systems. More specifically, the present solid propellant compositions have greatly increased performance along with the reduced HCl in the exhaust due to:

(1) Higher solids loading—88 to 89% solids as compared with earlier AN technology which was limited to approximately 80% maximum solids.

(2) Higher specific impulse—a theoretical specific impulse, at a chamber pressure of 1000 psia and expanding to sea level optimum conditions of 250 seconds as compared to conventional ammonium nitrate systems of 215 to 220 seconds. The high impulse is achieved through the combination of the high solids loading, the incorporation of aluminum metal fuel and a small amount of mixed oxidizers formulated to effect a high combustion efficiency.

(3) Higher burning rates achievable—the typical burning rate of conventional ammonium nitrate propellants was a maximum of approximately 0.1 in/s at 1000 psia. Burning rates of greater than 0.3 in/s at 1000 psia have been achieved.

(4) Combustion efficiency—the combustion efficiency of formulations with relatively high metal content (15 weight percent aluminum powder) are comparable, or within one to two percent, to that of conventional ammonium perchlorate propellants.

These and many other attendant advantages of the invention will become readily apparent as the description proceeds.

DESCRIPTION OF THE PREFERRED EMBODIMENTS

The binder component of the propellant includes an elastomeric hydrocarbon, curing ingredients and plasticizer.

Preferred binders are elastomeric hydrocarbon polymers formed by the chain extension and cross-linking reactions of functionally terminated liquid polybutadiene polymers. Such polymers may include carboxy-terminated polybutadiene cured with amines or epoxides, polybutadiene acrylonitrile-acrylic terpolymers cured with epoxides and hydroxy-terminated polybutadiene cured with diisocyanates. Hydroxy-terminated polybutadienes are preferred due to cost, reactivity, availability considerations, high loading capability and mechanical properties. The butadiene may be derived from the lithium initiated polymerization (Li-HTPB) or free radical initiated polymerization (FR-HTPB).

The composition may also contain a minor amount below 10% of various additives such as cure promoters, stabilizers and thixotropic control agents, or reactive polymeric modifiers such as one or more diols or polyols. The isocyanate is generally present in at least an equivalent amount sufficient to react with the hydroxy prepolymer and hydroxyl substituted modifiers.

The equivalent weight of the liquid prepolymer is at least 1,000 and not usually more than 5,000. The functionality of the polymer is advantageously from about 1.7 to about 3.0, preferably from about 2.3 to 2.5 to form by cross-linking and chain extending elastomeric polymers of molecular weight of at least 30,000. Since higher molecular weight prepolymers may require heat to reduce viscosity, the equivalent weight is preferably from 1,000 to 3,000.

The polyisocyanate for curing the prepolymer can be selected from those of the general formula $R(NCO)_m$ in which R is a di- or polyvalent organic radical containing from 2–30 carbon atoms and m is 2, 3 or 4. R can be alkylene, arylene, aralkylene or cycloalkylene. It is preferred that the organic radical be essentially hydrocarbon in character although the presence of unreactive groups containing elements other than carbon and hydrogen is permissible as is the presence of reactive groups which are not capable of reacting with isocyanate groups capable of forming urea or carbamate linkages such as to interfere with the desired reaction.

Examples of suitable compounds of this type include benzene-1,3-diisocyanate, hexane-1,6-diisocyanate, toluene-2,4-diisocyanate (TDI), toluene-2,3-diisocyanate, diphenylmethane-4,4'-diisocyanate, naphthylene-1,5-diisocyanate, diphenyl-3,3'-dimethyl-4,4'-diisocyanate, diphenyl-3,3'-dimethoxy-4,4'-diisocyanate, butane-1,4-diisocyanate, cyclohex-4-ene-1,2-diisocyanate, benzene-1,3,4-triisocyanate, naphthylene-1,3,5,7-tetraisocyanate, metaphenylene diisocyanate (MCI), isocyanate terminated prepolymers, polyaryl polyisocyanates and the like.

Polyols are preferably, but not limited to, diols or triols and can be either saturated or unsaturated aliphatic, aromatic or certain polyester or polyether products. Exemplary compounds include glycerol, ethylene glycol, propylene glycol, neopentylglycol. pentaerythritol, trimethylolethane, glycerol triricineolate, or alkylene oxide adducts of aniline such as Isonol which is N,N-bis-(2-hydroxypropyl)aniline and many other polyols well known in the art which can be incorporated into the binder composition to control the degree of cross-linking. The particular compound and amount utilized is dependent on the functionality and nature of the hydroxyl terminated prepolymer and polyisocyanate employed in the binder composition.

When the functionality of Li-HTPB is generally slightly less than 2, the polyol is preferably a triol so as to provide cross-linking between polymeric chains upon reaction with isocyanates. As exemplary polyols, mention may be made of glycerol triricinoleate (GTRO) and Isonol (a propylene oxide adduct of aniline), N,N-bis-(2-hydroxypropyl)-aniline. The functionality of the HTPB is preferably above 2 in order to reduce or eliminate the triol modifier. A suitable material is R-45M (ARCO) which has 2.4 OH/molecule and an equivalent weight of about 1300. The polyisocyanate is present in an amount necessary to satisfy stoichiometry, that is, the functionality of the HTPB and any other polyol present in the composition. The polyisocyanate may be a di-, tri- or higher functional material and may be aliphatic in nature such as hexane-diisocyanate but is preferably a cycloaliphatic polyisocyanate such as isophorone diisocyanate (IPDI) in order to control the cure rate. A catalytic cure promoting agent can be utilized. These agents may be metal salts such as metal acetylacetonates, preferably thorium acetylacetonate (ThAA) or iron acetylacetonate (FeAA).

The binder also preferably includes a major amount suitably from 30 to 50% by weight of an oxygenated plasticizer such as a higher alkyl (8 to 16 carbon atoms) ester in order to improve processing and to adjust the oxygen to carbon ratio in the propellant formulation. Suitable plasticizers are dioctyl adipate (DOA) and isodecyl pelargonate. The propellant formulation may also contain minor amounts below about 5% by weight of burning rate accelerators, such as iron oxide ($Fe_2O_3$), iron fluoride ($FeF_3$), Milori Blue, Ferrocene, iron phthalocyanine, ammonium dichromate (AD) or mixtures thereof.

The primary objective was the develpment of a candidate Alternate Propellant for the Shuttle boosters which would eliminate, or minimize, the HCl in the exhaust from the solid propellant boosters during operation above 65,000 feet altitude. The propellant was also designed to satisfy the following criteria:

1. Propellant Burning Rate=0.35 in/s at 1000 psia.
2. Propellant Pressure Exponent of the Burning Rate≦0.42.
3. Vacuum Delivered Specific Impulse≧245 s at an Expansion Ratio of 7.16.
4. Matched Burning Rates of the Alternate Propellant and the Baseline PBAN Propellant System at 580 psia.
5. HCl content of the propellant exhaust≦3%. This number four goal also introduced the requirement of modifying the burning rate of the existing Shuttle Baseline Propellant to meet a burning rate requirement consistent with the above stated goals for the Alternate Propellant. The burning rate requirement for the modified Shuttle Baseline Propellant, PBAN propellant, was established to be 0.32 in/s at 1000 psia chamber pressure.

These objectives and criteria were satisfied by propellant comprising a minor amount of hydrocarbon binder (10–15% by weight) and containing at least 80% solids including about 40% to 70% by weight of ammonium nitrate as the primary oxidizer, a significant amount of from 5% to 20% by weight of powdered metal fuel such as aluminum and a small amount of secondary oxidizer; from 5 to 35% by weight of ammonium perchlorate or a nitramine such as HMX (cyclotetramethylenetetranitramine) or mixtures thereof. The AN utilized is preferably a hard, prill type containing 0.4 to 0.6% MgO stabilizer having an average particle size of about 2000 μ.

Candidate propellants were formulated using R-45M, a HTPB having an equivalent weight of about 1300 and containing about 2.4 OH groups per prepolymer molecule. The HTPB was cured with an equivalent amount of IPDI and contained about 40% DOA oxygenated plasticizer. A modified baseline propellant having a burning rate of 0.32 in/s at 1000 psia was also formulated based on PBAN cured with an epoxy, Der-331. The aluminum content was held constant at 15% by weight. The formulations are provided in the following Table I, followed by theoretical performance, Table II, measured performance, Table III and exhaust composition, Table IV.

TABLE I

CANDIDATE PROPELLANT FORMULATIONS

| FORMULATION: | 1* | 2 | 3 | 4 | 5 | 6 |
|---|---|---|---|---|---|---|
| % Solids | 86 | 88 | 88 | 88 | 88 | 88 |
| % AN | — | 59.00 | 51.00 | 44.00 | 43.00 | 41.50 |
| % AP | 69.60 | 10.00 | 20.00 | 10.00 | 10.00 | 10.00 |
| % HMX(Class E) | — | — | — | 15.00 | 17.00 | 17.50 |
| % Al | 16.00 | 15.00 | 15.00 | 15.00 | 15.00 | 15.00 |
| % $Fe_2O_3$ | 0.40 | — | — | — | — | — |
| % AD | — | 2.00 | — | 2.00 | 1.00 | 2.00 |
| % CUO202 | — | 2.00 | 2.00 | 2.00 | 2.00 | 2.00 |
| % Binder | | | | | | |
| HTPB | — | 12.00 | 12.00 | 12.00 | 12.00 | 12.00 |
| PBAN | 14.00 | — | — | — | — | — |

*Current baseline shuttle propellant, developed and manufactured by the Thiokol Corporation.

TABLE II

| CANDIDATE PROPELLANT THEORETICAL PERFORMANCE | | | | | | |
|---|---|---|---|---|---|---|
| FORMULATION: | 1 | 2 | 3 | 4 | 5 | 6 |
| $T_f$, °K. | 3471 | 2695 | 2845 | 2748 | 2765 | 2756 |
| $T_e$, °K. | 2327 | 1563 | 1678 | 1570 | 1575 | 1571 |
| $C^*_t$, ft/s | 5155 | 4860 | 4949 | 4937 | 4965 | 4950 |
| $I_{sp}$, S | 262.3 | 246.8 | 251.1 | 249.9 | 251.2 | 250.4 |
| $I_{sp}$ vac, s at $\epsilon = 7.16$ | 276.7 | 261.9 | 266.3 | 265.2 | 266.6 | 265.8 |
| % HCL in Exhaust | 20.9 | 3.03 | 6.01 | 3.03 | 3.03 | 3.03 |
| % $Al_2O_3$ in Exhaust | 30.2 | 28.3 | 28.3 | 28.3 | 28.3 | 28.3 |

TABLE III

| MEASURED PERFORMANCE OF CANDIDATE PROPELLANTS | | | | | | |
|---|---|---|---|---|---|---|
| Ballistic | Program | TEST RESULTS(1) | | | | |
| Property | Goal | 2 | 3 | 4 | 5 | 6 |
| C*, ft/s | — | 4700 | 4791 | 4759 | 4694 | 4643 |
| C* Effic. % | — | 95.3 | 97.2 | 96.2 | 94.5 | 94.5 |
| $I_{sp}$ vac, s at $\epsilon = 7.16$ | ≧245 | 233.0 | 245.0 | 242.2 | 236.4 | 236.3 |
| $I_{sp}$ Effic. % | — | 88.8 | 92.3 | 91.2 | 88.7 | 89.01 |
| B.R., in/s at 1000 psia | ≧0.35 | 0.21 | 0.38(2) | 0.31 | 0.32 | 0.29 |
| Pressure Exponent (n) | ≦0.42 | 0.28 | 0.48 | 0.31 | 0.37 | 0.31 |
| Hazard Classification | 2 | 2 | 2 | 2 | 2 | 7 (Marginal) |

(1)Test Data from 70 lb BATES Motor firings at Pc≃500 psia.
(2)Data point based on 10 lb motor firings.

TABLE IV

| PROPELLANT EXHAUST COMPOSITION | | | | | | |
|---|---|---|---|---|---|---|
| PROPELLANT | PBAN | 2 | 3 | 4 | 5 | 6 |
| % Solids | 86 | 88 | 88 | 88 | 88 | 88 |
| % AP | 69.60 | 10 | 20 | 10 | 10 | 10 |
| % HMX | — | — | — | 15 | 17 | 17.5 |
| Te,° K. | 2327 | 1563 | 1678 | 1570 | 1575 | 1571 |
| Mol Wt. Prdts. | 27.56 | 23.09 | 23.60 | 22.85 | 22.75 | 22.81 |
| SPECIES(1) | Wt. % | Wt. % | Wt. % | Wt. % | Wt. % | Wt. % |
| AlCl | 0.0094 | — | — | — | — | — |
| AlClO | 0.0086 | — | — | — | — | — |
| $AlCl_2$ | 0.0098 | — | — | — | — | — |
| $ALCl_3$ | 0.0053 | — | — | — | — | — |
| $AlHO_2$ | 0.0012 | — | — | — | — | — |
| Cl | 0.2961 | — | 0.0007 | — | — | — |
| CO | 23.2928 | 18.9953 | 19.1619 | 25.6367 | 26.4700 | 26.7944 |
| $CO_2$ | 3.9486 | 6.1302 | 5.8769 | 4.6105 | 4.4899 | 4.2773 |
| $Cr_2O_3$(L) | — | 1.0020 | 0.2090 | 1.0020 | 0.6050 | 1.0020 |
| Cu | — | 0.0038 | 0.0184 | 0.0044 | 0.0044 | 0.0044 |
| CuC(L) | — | 1.4543 | 1.1840 | 1.4513 | 1.4475 | 1.4513 |
| CuCl | — | 0.0891 | 0.4188 | 0.0901 | 0.0940 | 0.0901 |
| Fe | 0.0134 | — | — | — | — | — |
| $FeCl_2$ | 0.5998 | 0.0621 | 0.0621 | 0.0596 | 0.0583 | 0.0583 |
| H | 0.0191 | 0.0001 | 0.0002 | 0.0001 | 0.0001 | 0.0001 |
| $H_2$ | 1.8804 | 2.9663 | 2.7301 | 3.2744 | 3.2941 | 3.3221 |
| HCl | 20.9284 | 3.0346 | 6.0149 | 3.0357 | 3.0346 | 3.0357 |
| HO | 0.0321 | — | 0.0002 | — | — | — |
| $H_2O$ | 10.1499 | 15.4534 | 15.7204 | 9.5971 | 9.1721 | 8.6539 |
| $N_2$ | 8.5862 | 22.1739 | 20.3436 | 22.5998 | 22.8954 | 22.6707 |
| $NH_3$ | — | 0.0005 | 0.0003 | 0.0005 | 0.0005 | 0.0005 |
| NO | 0.0018 | 0.5780 | — | — | — | — |
| O | 0.0005 | — | — | — | — | — |
| $O_2$ | 0.0003 | — | — | — | — | — |
| $Al_2O_3$(C) | 30.2097 | 28.3418 | 28.3418 | 28.3418 | 28.3418 | 28.3418 |

(1)Concentrations less than $1 \times 10^{-5}$ Moles/100gs exhaust are omitted.
NOTE: In the Table, the abbreviation (L) = liquid and (C) = crystals Seventy (70) pounds of the propellant system of formulation 2 containing 10% of ammonium perchlorate (AP) and 15% aluminum powder was tested in the BATES motor, static testing being limited to sea level conditions. A vacuum delivered $I_{sp}$ at an expansion ratio ($\epsilon$) of 7.0, corrected from the sea level data, of 232.6 s has been demonstrated. This measured value of $I_{sp}$ is equivalent to 88.8% of the theoretical value at the test conditions. A burning rate at 1000 psia of 0.215 in/s with a pressure exponent of the burning rate of 0.278 has also been demonstrated with BATES motor firings. As can be seen, the $I_{sp}$ and burning rate goals have not been attained while the pressure exponent goal has been exceeded by a considerable margin. It is doubtful whether the $I_{sp}$ or the burning rate goals can be achieved with this basic system within the previously defined constraints. One way of achieving the ballistic goals, would be to increase the AP content of this propellant. To do so, however, would increase the HCl content of the exhaust above that of the current exhaust constrainst of not more than 3 wt. % of HCl.

In order to meet the specific impulse and burning rate goals a propellant formulation (No. 3) containing 20 wt.% of AP was developed and tested first in 10 lb motors followed by two 70 lb BATES motor firings. The specific impulse goal of 245 seconds was attained with this propellant. The burning rate at 1000 psia exceeded the 0.35 in/s goal. A burning rate of 0.38 was measured. The pressure exponent measured was 0.5 which is higher than the goal. However, it is believed that this pressure exponent can be reduced. The HCl content in the exhaust, at an expansion ratio of 7.16 is calculated to be 6 wt. %. This 6% HCl still represents an 80% reduction in the HCl content from that of the baseline PBAN propellant system (No. 1). The hazards classification of the AN/AP/HTPB system is Class 2.

The system containing both AP and HMX is the best candidate, to date, for meeting all the program goals. Theoretical calculations showed that the maximum specific impulse for this propellant system was in the range of 17.0 to 17.5% HMX. Therefore this system with three levels of HMX was developed, scaled up to 250 lb mixes, and loaded and test fired in 10 lb test motors followed by 70 lb BATES motor firing. Of the three levels of HMX (Formulation Nos. 4,5,6) evaluated in motor firing the highest $I_{sp}$ was measured with the formulation containing 15 wt.% HMX, showing that the experimental optimum HMX level is somewhat less than 17 wt.% for this system. The 15% and 17 wt.% HMX formulations were demonstrated to be Class 2 while the 17.5 wt.% HMX propellant was borderline Class 7.

Preliminary results from Crawford Bomb burning rates showed a burning rate of 0.374 in/s at 1000 psia for the 17 wt.% HMX formulation. Indications were that the 0.35 in/s burning rate would be achieved in motor tests with 3% burning rate modifier in the formulation — a cut-back from the 4% in the other two HMX formulations. A reduction in the ballistic modifier (a mixed burning rate catalyst) of 1% was made in the scale-up propellant batch from which the BATES motors were loaded. Unfortunately this was too large a reduction in modifier and test results from firing the BATES motors showed a burning rate of 0.32 in/s for the 17 wt.% HMX formulation (No. 5).

Table III summarizes the measured performance values as determined by 70 lb. BATES motor firings. The test firings were conducted under sea level conditions with nozzle expansion ratios of 7.16. The measured sea level values were then corrected to vacuum values by the following equation:

$$I_{sp}\,\text{vac. ms.} = I_{sp}\,\text{act. ms.} + \frac{P_e A_e}{\dot{W}}$$

The 0.32 in/s burning rate for the modified baseline propellant (Formulation No. 1) was demonstrated in motor firings. The desired modification was accomplished by removing the iron oxide burning rate catalyst ($Fe_2O_3$) and adjusting the particle size blend of the oxidizer. The burning rate equation for this modified base-line is $r=0.0668\ Pc^{0.228}$.

The exhaust compositions of the five candidate propellants listed in Table IV and also the shuttle PBAN baseline propellant, are shown in Table IV. The exhaust species are shown as weight percent of the total exhaust; and the exhaust composition is that at the exit plane of the nozzle with an expansion ratio of 7.16, calculated as the equilibrium composition. Zero chloride was achieved and low HCl levels (mostly 3%).

An 88% solids, 15% Al, ammonium nitrate formulation containing no AP was test fired in several 5 lb test motors and 70 lb BATES motors. In each case large amounts of aluminum slag remained in the motors after firing. Molten aluminum could be seen ejected through the nozzle during the test firings. Greatly improved combustion resulted from incorporating 5% AP in the formulation. The incorporation of 10% AP resulted in virtually zero slag remaining in the motor. Photographs of BATES motor test containing 0,% 5% and 10% AP respectively in the formulations show rather dramatically the effect of AP on the combustion. Glowing streaks in the 0% and 5% AP firings which was greatly reduced in the 5% AP test are produced by molten aluminum.

Other modifications are permissible, the formulation and testing to date indicated that the optimum AN content is probably about 63% with 10% AP and 15% Al in an 88% solids system absent nitramine. The propellant may also contain highly energetic plasticizers such as TMETN (1,1,1-trimethylol ethane trinitrate). However the small potential performance gains possible with TMETN do not justify the potential hazard or compatibility problems with ballistic modifiers, TMETN migration and aging degradation.

Initial burning rate studies were made to evaluate different ballistic modifier types and levels with the basic 88 wt.% solids AN/AP/Al/HTPB propellant. The selection of the ballistic modifiers was limited to those that met the following requirements:

1. Commercially available.
2. Proven successful use within rubber base propellants.
3. Non-migrating.
4. Reasonable cost.

Ammonium dichromate, $(NH_4)_2Cr_2O_7$, at the 2 wt.% level was selected as the primary ballistic modifier for the following reasons:

1. Ammonium nitrate, AN, is the major oxidizer.
2. AD has been used successfully for years with AN propellants.

Other ballistic modifiers were used in conjunction with the AD to enhance burning rate and attempt to achieve the burning rate goal of 0.35 in/sec. at 1000 psia.

The propellant formulations were mixed as small (1000 to 1500 gram) batches using a 1-gallon vertical Bramley mixer. The propellant was cast into a RAM-225 released molds which formed individual propellant strands and was then cured. After cure the propellant strands were tested in a conventional Crawford bomb strand burner. General conclusions from the study were as follows:

1. The ballistic modifier system using 2 wt.% ground ammonium dichromate, AD, and 2 wt.% copper chromite, CUO202, gave the fastest burn rate.

2. Increasing the combined level of burning rate modifiers to greater than 4 wt.% of the formulation decreased the burn rate.

Although the attritor ground (1μ) ferric fluoride, $FeF_3$, gave a faster burning rate than CUO202 at the 1 wt.% second ballistic modifier level, $FeF_3$ was not selected because it would have contributed HF in the propellant exhaust.

Table V shows the formulations evaluated and the cured strand burning rates obtained.

TABLE V

EVALUATION OF BALLISTIC MODIFIER TYPE AND LEVEL AN/AP/Al/HTPB PROPELLANT

| FORMULATION (Wt. %) | | | | | | | OXIDIZER BLEND | STRAND RATE (In./S.) | BURNING DATA (In./S.) |
|---|---|---|---|---|---|---|---|---|---|
| TOTAL SOLIDS | AN | AP | Al | AD (7μ) | OTHER BALLISTIC MODIFIER | | COARSE / FINE | $r_b$ AT 500 psia & 70° F. | $r_b$ AT 100 psia & 70° F. |
| 88 | 60 | 10 | 15 | 2 | $Fe_2O_3$ | 1% | 45/55 | 0.148 | 0.212 |
| 88 | 59 | 10 | 15 | 2 | $Fe_2O_3$ | 2% | 44.2/55.8 | 0.118 | 0.187 |
| 88 | 57 | 10 | 15 | 2 | $Fe_2O_3$ | 4% | 42.5/57.5 | 0.110 | 0.170 |
| 88 | 60 | 10 | 15 | 2 | Copper chromite | 1% | 45/55 | 0.182 | 0.247 |
| 88 | 59 | 10 | 15 | 2 | Copper chromite | 2% | 44.2/55.8 | 0.222 | 0.299 |
| 88 | 57 | 10 | 15 | 2 | Copper chromite | 4% | 42.5/57.5 | 0.186 | 0.264 |
| 88 | 59 | 10 | 15 | 2 | Copper chromite | 1% | | | |
| | | | | | $Fe_2O_3$ | 1% | 44.2/55.8 | 0.194 | (Est. 0.290) |
| 88 | 57 | 10 | 15 | 2 | Copper chromite | 2% | | | |
| | | | | | $Fe_2O_3$ | 2% | 42.5/57.5 | 0.201 | 0.275 |
| 88 | 57 | 10 | 15 | 2 | Copper chromite | 2% | | | |
| | | | | | $FeF_3$(Ung) | 2% | 42.5/57.5 | 0.191 | 0.255 |
| 88 | 60 | 10 | 15 | 2 | Milori Blue | 1% | 45/55 | 0.157 | 0.246 |
| 88 | 57 | 10 | 15 | 2 | Milori Blue | 4% | 42.5/57.5 | 0.146 | 0.208 |
| 88 | 60 | 10 | 15 | 2 | Ferrocene | 1% | 45/55 | 0.150 | 0.224 |
| 88 | 60 | 10 | 15 | 2 | Ferric Fluoride (as rcvd.) | 1% | 45/55 | 0.169 | 0.234 |
| 88 | 57 | 10 | 15 | 2 | Ferric Fluoride (as rcvd.) | 4% | 42.5/57.5 | 0.140 | 0.193 |
| 88 | 60 | 10 | 15 | 2 | Iron Phthalocyanine | 1% | 45/55 | 0.141 | 0.193 |

NOTE: Strand burn rates possibly biased by RAM-225 mold release.

Antioxidants are commonly used with R-45 HTPB binder to improve propellant pot life and aging stability. The combination of UOP-36 (N'-cyclohexyl-P-phenylene diamine) and DTBH (2,5 di-tertiary butyl hydroquine) appears to give synergistic effects and is very effective in extending pot-life. Protech 2002 (UTC proprietary metal-deactivating antioxidant) and others of the Protech series have the additional advantage of being metal scavengers. They tie up the transition metals which catalyze radical oxidations. Four small scale propellant batches were made initially to evaluate these pot-life extenders. The combination of UOP-36 and DTBH gave some improvement in propellant castability with no significant effect on propellant burning rate. No improvement in propellant castability was observed with use of the Protech 2002. The combination of UOP-36 and DTBH was selected as the pot-life extender system to be used for additional evaluation.

Dioctyl adipate (DOA) was chosen initially as the plasticizer for use with the basic AN/AP/Al/HTPB propellant. It is one of the most commonly used plasticizers and it has the advantage of low cost. Isodecyl pelargonate (IDP) has a lower viscosity and freezing point than DOA, but is more costly than DOA. Six small scale propellant batches were made and tested to compare the two plasticizers, DOA and IDP, under the following three conditions:

1. At the 40% plasticizer in binder level without pot-life extenders.
2. At the 40% plasticizer in binder level with UOP-36 and DTBH pot-life extenders.
3. At the 50% plasticizer in binder level with UOP-36 and DTBH pot-life extenders.

Results of the study are summarized in Table VI.

TABLE VI

EVALUATION OF PLASTICIZERS AND POT LIFE EXTENDERS AN/AP/Al/HTPB PROPELLANTS

| Batch Number / Formulation Number | SB-67 AN-57 | SB-68 AN-58 | SB-64 AN-25 | SB-70 AN-60 | SB-75 AN-63 | SB-76 AN-64 |
|---|---|---|---|---|---|---|
| | (Wt.%) | | | | | |
| HTPB binder | 5.92 | 5.92 | 7.20 | 7.20 | 7.12 | 7.12 |
| DTBH (2,5 di-tertiary butyl hydroquinone) | 0.04 | 0.04 | — | — | 0.04 | 0.04 |
| UOP-36 (N-phenyl-N'-cyclohexyl-P-phenylene diamine) | 0.04 | 0.04 | — | — | 0.04 | 0.04 |

TABLE VI-continued

EVALUATION OF PLASTICIZERS AND POT LIFE EXTENDERS AN/AP/Al/HTPB PROPELLANTS

| Batch Number<br>Formulation Number | SB-67<br>AN-57 | SB-68<br>AN-58 | SB-64<br>AN-25 | SB-70<br>AN-60 | SB-75<br>AN-63 | SB-76<br>AN-64 |
|---|---|---|---|---|---|---|
| DOA | 6.00 | — | 4.80 | — | 4.80 | — |
| IDP | — | 6.00 | — | 4.80 | — | 4.80 |
| Aluminum, MD-105 | 15.00 | 15.00 | 15.00 | 15.00 | 15.00 | 15.00 |
| Ammonium Hammer mill ground dichromate: 6.3μ | | | | | | |
| Copper As received chromite: 2.1μ | 2.00 | 2.00 | 2.00 | 2.00 | 2.00 | 2.00 |
| Ammonium Screened unground nitrate: Gulf Oil +60 −32 mesh | 27.00 | 27.00 | — | — | — | — |
| Ammonium Unground nitrate: Gulf Oil | — | — | 30.50 | 30.50 | 27.00 | 27.00 |
| Ammonium Fine ground nitrate: Gulf Oil | 32.00 | 32.00 | 28.50 | 28.50 | 32.00 | 32.00 |
| Ammonium Hammer mill perclorate: ground 9μ | — | — | 10.00 | 10.00 | 10.00 | 10.00 |
| Ammonium: Fluid energy mill perchlorate: ground 5.5μ | 10.00 | 10.00 | — | — | — | — |
| Totals | 100.00 | 100.00 | 100.00 | 100.00 | 100.00 | 100.00 |
| Relative Castability | Good | Excellent | Poor | Good | Good | Excellent |
| Strand Burning Rates (in/s. at 770° F.) | | | | | | |
| at 500 psia | 0.148 | 0.146 | 0.144 | 0.188 | 0.163 | 0.139 |
| at 1000 psia | 0.225 | 0.210 | 0.199 | 0.259 | 0.227 | 0.197 |
| Strand Pressure Exponent (500 to 1000 psia) | 0.59 | 0.53 | 0.47 | 0.46 | 0.49 | 0.48 |

NOTE: Strand burn rates possibly biased by RAM-225 mold release.

General conclusions from the study were:

1. The IDP consistently gave better castability than the DOA.

2. Use of pot-life extenders UOP-36 and DTBH improved castability with both of the plasticizers, DOA and IDP.

3. No major improvement in castability was observed by increasing the plasticizer in binder level from 40 to 50 Wt.%.

It is to be understood that only preferred embodiments of the invention have been described and that numerous substitutions, modifications and alterations are permissible without departing from the spirit and scope of the invention as defined in the following claims.

What is claimed is:

1. A solid rocket propellant having greatly reduced hydrogen chloride emission comprising:

about 10–15% of an elastomeric butadiene polymer binder containing over 85% by weight solids;

the solids including 40% to 70% ammonium nitrate as a primary oxidizer, 5% to 20% powdered metal fuel and 5% to 35% of a secondary oxidizer including 5% to 25% ammonium perchlorate and 10% to 20% of an organic nitramine oxidizer.

2. A propellant according to claim 1 in which the butadiene polymer is a hydroxy-terminated polybutadiene having an equivalent weight from 1,000 to 5,000 and a functionality from about 1.7 to 3.0.

3. A propellant according to claim 2 in which the butadiene polymer is cured with a stoichiometric amount of a cycloaliphatic diisocyanate.

4. A propellant according to claim 3 in which the diisocyanate is isophorone diisocyanate.

5. A propellant according to claim 1 in which the binder is present in an amount from 10% to 15% by weight and the binder further includes from 30% to 50% of an oxygenated plasticizer.

6. A propellant according to claim 5 in which the oxygenated plasticizer is a higher alkyl ester.

7. A propellant according to claim 6 in which the plasticizer is dioctyl adipate.

8. A propellant according to claim 1, in which the secondary oxidizer is a mixture of 5% to 15% ammonium perchlorate and 10% to 20% cyclotetramethylenetetranitramine.

9. A propellant according to claim 8 further including from 0.5% to 3% of a burning rate modifier selected from $Fe_2O_3$, copper chromite, $FeF_3$, Milori Blue, Ferrocene, iron phthalocyanine, ammonium dichromate and mixtures thereof.

* * * * *